US010102957B2

(12) United States Patent
Itoh et al.

(10) Patent No.: US 10,102,957 B2
(45) Date of Patent: Oct. 16, 2018

(54) METHOD FOR MANUFACTURING TRANSFORMER APPARATUS

(71) Applicant: FUJITSU LIMITED, Kawasaki-shi, Kanagawa (JP)

(72) Inventors: Masayuki Itoh, Kawasaki (JP); Hiroshi Kurosawa, Kawasaki (JP)

(73) Assignee: FUITSU LIMITED, Kawasaki (JP)

( * ) Notice: Subject to any disclaimer, the term of this patent is extended or adjusted under 35 U.S.C. 154(b) by 141 days.

(21) Appl. No.: 15/204,771

(22) Filed: Jul. 7, 2016

(65) Prior Publication Data

US 2016/0322161 A1 Nov. 3, 2016

Related U.S. Application Data

(62) Division of application No. 14/465,186, filed on Aug. 21, 2014, now Pat. No. 9,570,223.

(30) Foreign Application Priority Data

Oct. 9, 2013 (JP) ..... 2013-211887

(51) Int. Cl.
*H01F 27/02* (2006.01)
*H01F 27/28* (2006.01)
(Continued)

(52) U.S. Cl.
CPC ..... *H01F 27/027* (2013.01); *H01F 17/06* (2013.01); *H01F 27/2828* (2013.01);
(Continued)

(58) Field of Classification Search
CPC .... H01F 27/027; H01F 27/2828; H01F 41/10; H01F 2019/085; H01F 17/06; Y10T 29/49073
See application file for complete search history.

(56) References Cited

U.S. PATENT DOCUMENTS 5,986,894 A * 11/1999 Lint ..... H01F 17/062 336/229
7,940,154 B2 5/2011 Chow et al.
2001/0008044 A1* 7/2001 Machado ..... H01F 27/027 29/840

FOREIGN PATENT DOCUMENTS

JP 61-237382 A 10/1986
JP 11-243021 A 9/1999
JP 2009-252834 A 10/2009

OTHER PUBLICATIONS

Office Action U.S. Appl. No. 14/465,186 dated Aug. 1, 2016.
Office Action U.S. Appl. No. 14/465,189 dated Aug. 1, 2016.

* cited by examiner

*Primary Examiner* — Livius R Cazan
(74) *Attorney, Agent, or Firm* — Fujitsu Patent Center

(57) ABSTRACT

A transformer apparatus includes: a case with a component mounting surface; an external-terminal provided on a wall adjacent to the component mounting surface of the case; a transformer provided on the component mounting surface and including a magnetic core and a winding; and a support provided in a position between the external-terminal and the core on the component mounting surface, and including a first-slit in a top surface of the support, the first-slit holding a first-conductor of the winding drawn from the core and a second-conductor drawn from the external-terminal, wherein the first-conductor is held at one end of the first-slit by a conductive member, the second-conductor is held at the other end of the first-slit by the conductive member, the first-conductor and the second-conductor are electrically connected through the conductive member, and the first-conductor and the second-conductor have surplus lengths.

7 Claims, 9 Drawing Sheets

(51) Int. Cl.
*H01F 17/06* (2006.01)
*H01F 41/10* (2006.01)
*H01F 19/08* (2006.01)

(52) U.S. Cl.
CPC ..... *H01F 41/10* (2013.01); *H01F 2019/085* (2013.01); *Y10T 29/49073* (2015.01)

METHOD FOR MANUFACTURING TRANSFORMER APPARATUS

CROSS-REFERENCE TO RELATED APPLICATION

This application is a divisional of U.S. patent application Ser. No. 14/465,186 filed on Aug. 21, 2014 and claims the benefit of priority of the prior Japanese Patent Application No. 2013-211887, filed on Oct. 9, 2013, the entire contents of which are incorporated herein by reference.

FIELD

The embodiments discussed herein are related to a transformer apparatus and a method for manufacturing a transformer apparatus.

BACKGROUND

There has heretofore been known a choke transformer for power circuit, including a flat magnetic core (hereinafter simply referred to as the core), a coil wound around the core, and two terminals formed at both ends on a surface of the core and electrically connected to both ends of the coil (see, for example, Japanese Laid-open Patent Publication No. 11-243021). In this choke coil, lead wires are connected to the terminals by high-temperature solder, and the terminals are bonded to the surface of the core with a conductive adhesive such that the lead wires are inserted between the terminals and the core.

Moreover, with the widespread use of the Internet, digital TV, and the like, a pulse transformer has been recently put into practical use as a transformer apparatus to efficiently transmit a pulse signal handled in a digital circuit. Particularly, in a LAN interface device mounted on information equipment such as a personal computer or audiovisual (AV) equipment combining audio and visual, a pulse transformer is used for the purpose of insulation and noise removal. The pulse transformer has the same configuration as that of a power circuit transformer intended for voltage conversion. Specifically, primary-side and secondary-side windings are wound around a core and are insulated from each other, and thus there is no electrical conduction therebetween. The pulse transformer is the same as the power circuit transformer in that signal transmission is performed by magnetic coupling and a voltage proportional to the number of windings is induced.

As illustrated in FIGS. 1A and 1B, a transformer apparatus 2 includes a transformer 10 placed therein. The transformer 10 is mounted in a case 20 having a structure in which gull-wing-shaped (L-shaped) external terminals 30 are drawn from two sides. The size of the case 20 having the transformer 10 mounted therein is about 10 mm in length, 18 mm in width, and 2 mm in height. The size of a core 12 in the transformer 10 mounted inside is about 2 to 4 mm in diameter.

When a winding 14 wound around the core 12 in the transformer 10 mounted inside the case 20 is connected to the external terminal 30, it is generally performed to wind an end (hereinafter referred to as a conductor) 60 of the winding 14 around a winding section 32 of the external terminal 30 and then connect the conductor 60 with solder or the like.

Note that FIG. 1B omits illustration of the solder to connect the conductor 60 of the winding 14 wound around the winding section 32 of the external terminal 30 to the winding section 32. When the conductor 60 of the winding 14 is wound around the winding section 32 of the external terminal 30, the conductor 60 of the winding 14 is wound around the winding section 32 in a tensioned state. Thus, tension is generated to remove slack in the conductor 60 of the winding 14.

In the transformer apparatus illustrated in FIG. 1B, when the transformer 2 is mounted on a circuit board while maintaining the tension generated in the conductor 60 of the winding 14 wound around the core 12, the conductor 60 of the winding 14 is thermally expanded by heat from the solder in a solder reflow process.

However, when the transformer apparatus 2 is cooled after the mounting thereof on the circuit board, the expanded conductor 60 of the winding 14 is thermally contracted, leading to a risk of disconnection of the conductor 60.

It is an object of one aspect of the present disclosure to provide a transformer apparatus and a method for manufacturing a transformer apparatus, which may reduce disconnection of a transformer winding while maintaining high reliability between the transformer winding and an external terminal.

SUMMARY

According to an aspect of the invention, a transformer apparatus includes: a case with a component mounting surface; an external-terminal provided on a wall adjacent to the component mounting surface of the case; a transformer provided on the component mounting surface and including a magnetic core and a winding; and a support provided in a position between the external-terminal and the core on the component mounting surface, and including a first-slit in a top surface of the support, the first-slit holding a first-conductor of the winding drawn from the core and a second-conductor drawn from the external-terminal, wherein the first-conductor is held at one end of the first-slit by a conductive member, the second-conductor is held at the other end of the first-slit by the conductive member, the first-conductor and the second-conductor are electrically connected through the conductive member, and the first-conductor and the second-conductor have surplus lengths.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

Figure 1A:
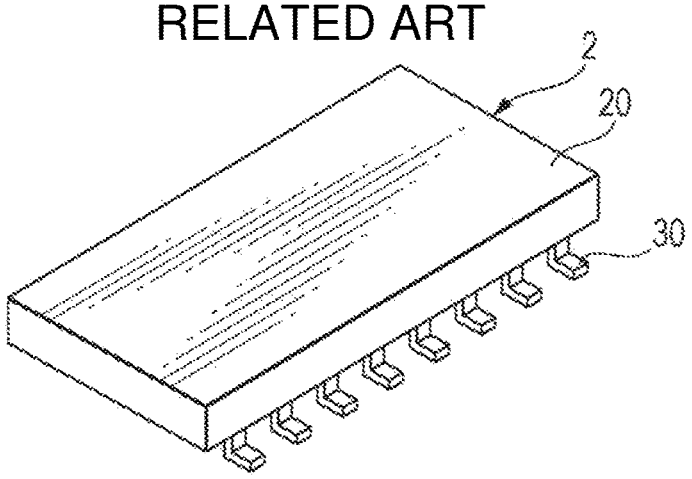
FIG. 1A RELATED ART
FIG. 1A is a perspective view seen from a top side of a package of a transformer apparatus according to a comparative technology.
Figure 1B:
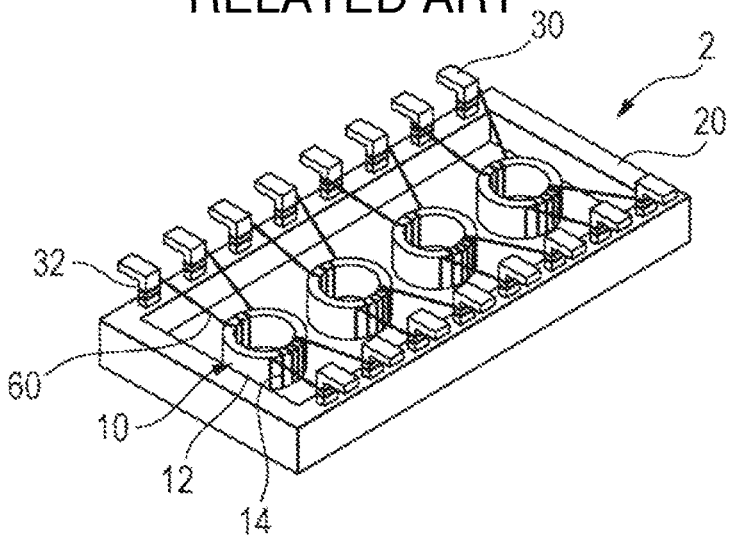
FIG. 1B RELATED ART
FIG. 1B is a back view seen from a back side of the transformer apparatus illustrated in FIG. 1A.

Hereinafter, an embodiment of the present disclosure is described in detail based on specific examples with reference to the accompanying drawings. Note that, in the following description, the same members also used in the embodiment of the present disclosure, as those inside the transformer apparatus 2 according to the comparative technology described with reference to FIGS. 1A and 1B, are denoted by the same reference numerals. More specifically, a transformer 10, a core 12, a winding 14, a case 20, an external terminal 30, a winding section 32 and a conductor 60 are described without changing the reference numerals.

Figure 2A:
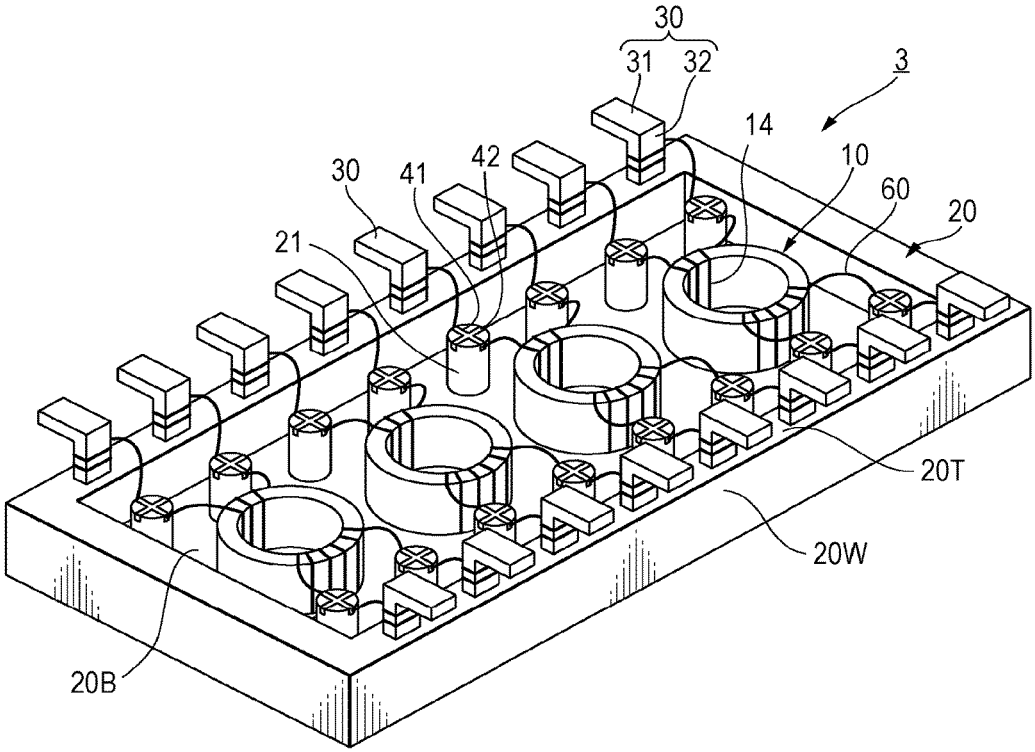
FIG. 2A is a back view seen from a back side of a transformer apparatus according to the present disclosure.
Figure 2B:
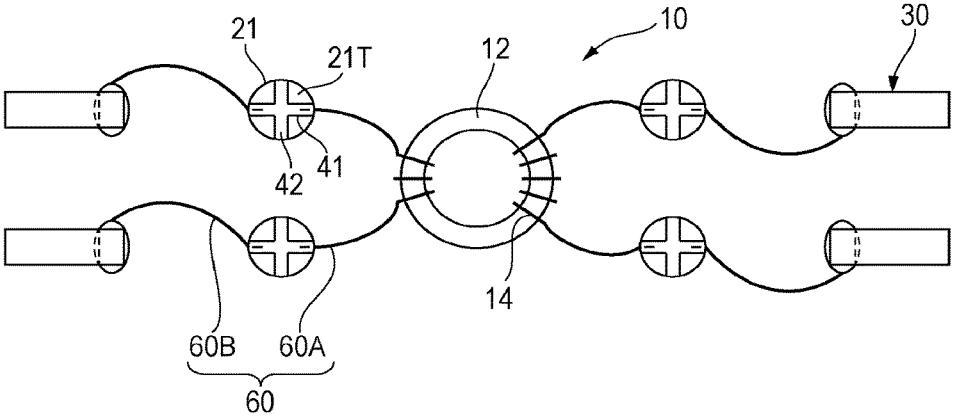
FIG. 2B is a wiring diagram illustrating cable wiring in which a winding of one of cores in the transformer apparatus illustrated in FIG. 2A is connected to an external terminal via a support.
Figure 3A:
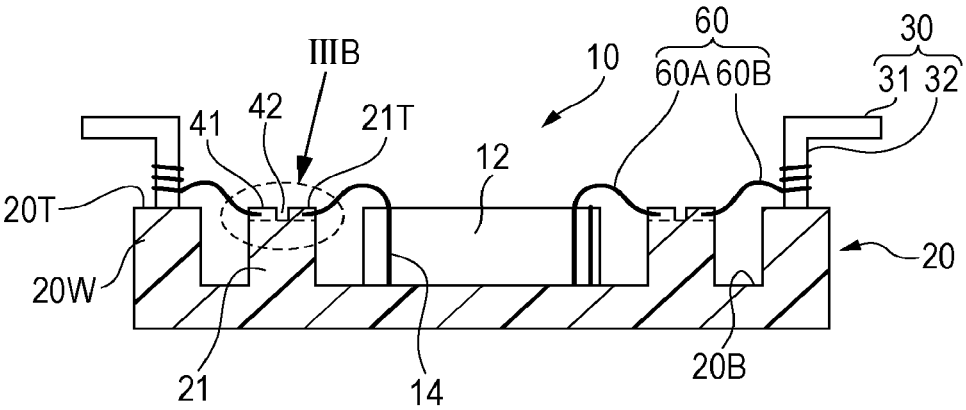
FIG. 3A is a cross-sectional view in a short direction of the transformer apparatus illustrated in FIG. 2A.
Figure 3B:
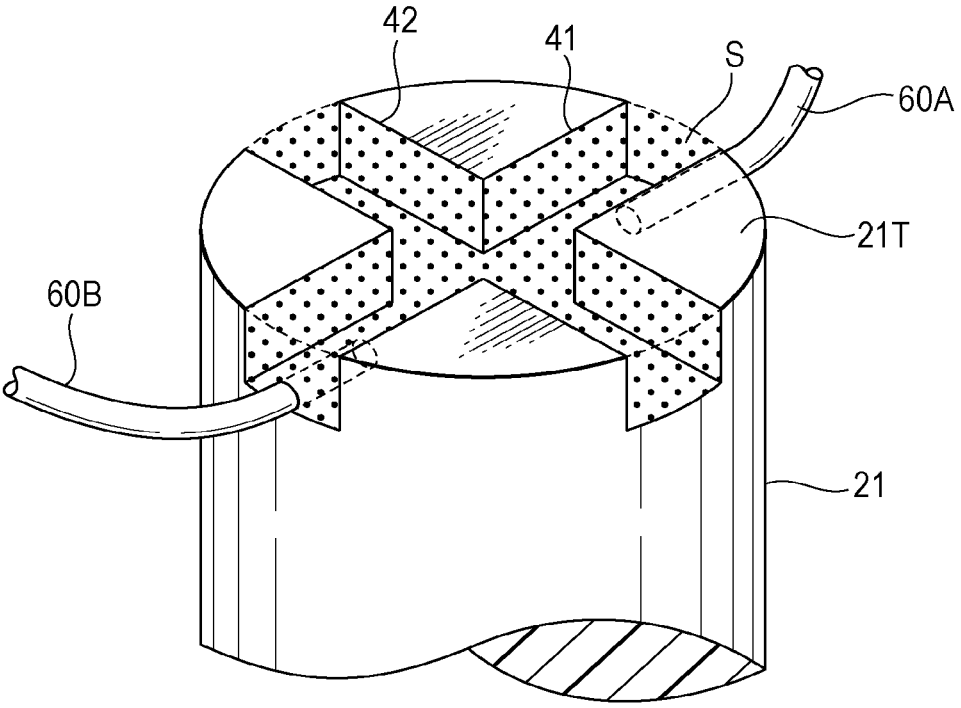
FIG. 3B is a perspective view of Section IIIB in FIG. 3A.

FIGS. 2A and 2B and FIGS. 3A and 3B illustrate a structure of a transformer apparatus 3 according to an example of the present disclosure. FIG. 2A is a view seen from a back side of the transformer apparatus 3 and corresponds to the view seen from the back side of the transformer apparatus 2 according to the comparative technology illustrated in FIG. 1B. FIG. 2B illustrates a state where a winding 14 wound around a core 12 of one of transformers 10 in the transformer apparatus 3 illustrated in FIG. 2A is connected to an external terminal 30 via a support 21. FIG. 3A illustrates a cross-section in a short direction of the transformer apparatus 3 illustrated in FIG. 2A, and FIG. 3B is an enlarged perspective view of Section IIIB in FIG. 3A.

A case 20 of the transformer apparatus 3 has the same shape and material as those of the case 20 described with reference to FIGS. 1A and 1B, and a bottom surface 20B thereof serves as a component mounting surface. A plurality of external terminals 30 are provided on top surfaces 20T of walls 20W provided along two sides in a longitudinal direction of the bottom surface of the case 20. Each of the external terminals 30 includes: a winding section 32 perpendicular to the top surface 20T; and an attachment section 31 extending parallel to the top surface 20T from a tip of the winding section 32. More specifically, the external terminal 30 is the gull-wing-shaped (L-shaped) external terminal described in the comparative technology. Similarly to the case of the transformer apparatus according to the comparative technology, a conductor 60 that is a lead-out portion of the winding 14 wound around the core 12 of the transformer 10 is wound around the winding section 32.

In this example, four transformers 10 are mounted on the bottom surface 20B of the case 20, and eight external terminals 30 are provided on each of the two opposed walls 20W. Also, the same number of supports 21 as the external terminals 30 are protruded on the bottom surface 20B positioned between the transformers 10 and the external terminals 30.

In this example, the conductor 60 is cut in the middle and divided into a core-side conductor (first conductor) 60A and an external terminal-side conductor (second conductor) 60B. Therefore, the conductor 60 means one in a state where the first conductor 60A and the second conductor 60B are connected. Also, a first slit 41 and a second slit 42 intersecting the first slit 41 are provided on the top surface 21T of each of the supports 21 protruded on the bottom surface 20B. Specifically, the first slit 41 longitudinally traverses the top surface 21T and has openings, on the side of the support 21, which face toward the core 12 and the external terminal 30, respectively. While bottom surfaces of the first and second slits 41 and 42 are flat in this example, the bottom surfaces may be curved or round.

In this example, the second slit 42 is provided in a direction perpendicular to the first slit 41. The first slit 41 has a width and a depth that allows the conductor 60 to fit therein. When the thickness of the conductor 60 changes, the width and depth of the first slit 41 also changes. While a depth of the second slit 42 may be equal to that of the first slit 41, a width thereof may be smaller than that of the first slit 41, which allows a cutter configured to cut the conductor 60 fitted in the first slit 41 to fit therein. The cut section sides of the first and second conductors 60A and 60B are separated from each other inside the first slit 41 and electrically connected to each other by solder S, as illustrated in detail in FIG. 3B. A conductive adhesive may be used instead of the solder. Moreover, although both of the first and second slits 41 and 42 are filled with the solder S in this example, at least the first slit 41 may be filled with the solder S.

Furthermore, in the transformer apparatus 3 of this example, the first conductor 60A between the core 12 and the support 21 and the second conductor 60B between the support 21 and the external terminal 30 have no tension and have surplus lengths. Accordingly, even when cooling of the transformer apparatus 3 after soldering of the transformer apparatus 3 to a circuit board shortens the lengths of the first and second conductors 60A and 60B, no tension is generated in the first and second conductors 60A and 60B, thereby easing the concerns about disconnection. Moreover, in the transformer apparatus 3 of this example, since the first and second conductors 60A and 60B are connected to each other by the solder S or conductive adhesive inside the first slit 41, the solder S no longer runs over the top surface 21T of the support 21. Thus, high reliability of the connection between the external terminal 30 and the winding 14 of the transformer 10 is maintained.

Although the cross-sectional shape of the support 21 is a circle in the example described above, the cross-sectional shape of the support 21 is not particularly limited but may have an area that allows the first slit 41 to be formed in the top surface. Here, some examples of the support 21 are described with reference to FIGS. 4A to 4G and FIGS. 5A to 5D. In the description of the examples, it is assumed that the support 21 described with reference to FIGS. 2A and 2B and FIGS. 3A and 3B is a first example, and reference numerals of supports in the other examples are all 21, reference numerals of top surfaces are all 21T, reference numerals of first slits are all 41, and reference numerals of second slits are all 42.

Figure 4A:
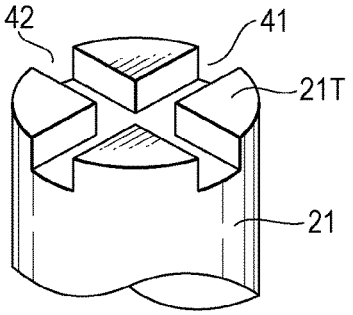
FIG. 4A is a partial perspective view illustrating a first example of a top surface of the support applied to the transformer apparatus according to the present disclosure.

FIG. 4A illustrates the first example of the support 21 applied to the transformer apparatus 3 according to the present disclosure described above. In the first example, the support 21 has a cylindrical shape with a circle cross-section. A first slit 41 provided in a top surface 21T traverses the top surface 21T through the center of the circle. Also, a second slit 42 is provided in a direction perpendicular to the first slit 41.

Figure 4B:
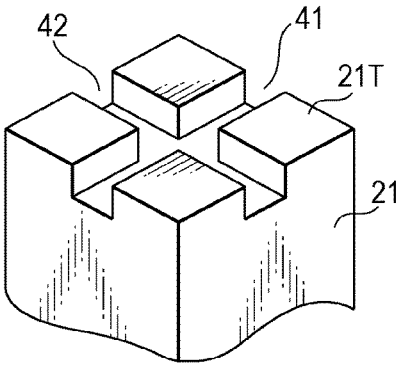
FIG. 4B is a partial perspective view illustrating a second example thereof.

FIG. 4B illustrates a second example of the support 21 applied to the transformer apparatus 3 according to the present disclosure. In the second example, the support 21 has the shape of a square pole with a square cross-section. A first slit 41 provided in a top surface 21T traverses the top surface 21T through the center of the square from one side to an opposite side of the square. Also, a second slit 42 is provided in a direction perpendicular to the first slit 41 in such a manner as to pass through the center of the square.

Figure 4C:
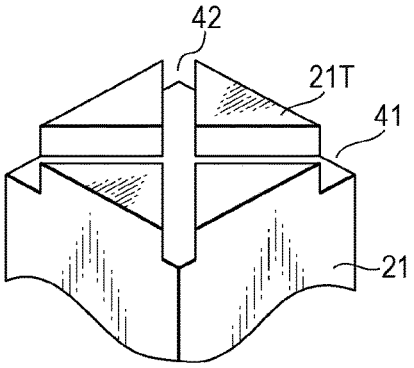
FIG. 4C is a partial perspective view illustrating a third example thereof.

FIG. 4C illustrates a third example of the support 21 applied to the transformer apparatus 3 according to the present disclosure. In the third example, the support 21 has the shape of a square pole with a square cross-section. A first slit 41 provided in a top surface 21T traverses the top surface 21T in a diagonal direction of the square. Also, a second slit 42 is provided in another diagonal direction of the square.

Figure 4D:
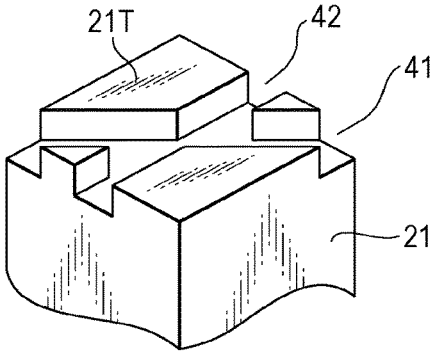
FIG. 4D is a partial perspective view illustrating a fourth example thereof.

FIG. 4D illustrates a fourth example of the support 21 applied to the transformer apparatus 3 according to the present disclosure. The fourth example is the same as the third example in a point that the support 21 has the shape of a square pole with a square cross-section and a first slit 41 provided in a top surface 21T traverses the top surface 21T in a diagonal direction of the square. While the second slit 42 is provided in another diagonal direction of the square in the third example, a second slit 42 is provided in a direction not perpendicular to the first slit 41 but oblique to the first slit 41.

Figure 4E:
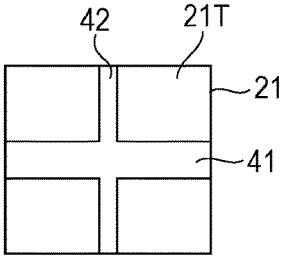
FIG. 4E is a partial perspective view illustrating a fifth example thereof.

FIG. 4E is a plan view of a support 21, illustrating a fifth example of the support 21 applied to the transformer apparatus 3 according to the present disclosure. In the fifth example, the support 21 has the shape of a square pole with a square cross-section. A first slit 41 provided in a top surface 21T traverses the top surface 21T through the center of the square from one side to an opposite side of the square. Also, the fifth example is the same as the second example in a point that a second slit 42 is provided in a direction perpendicular to the first slit 41 in such a manner as to pass through the center of the square, but differs from the second example in a point that the second slit 42 is formed to have a slit width smaller than that of the second slit 42 in the second example.

Figure 4F:
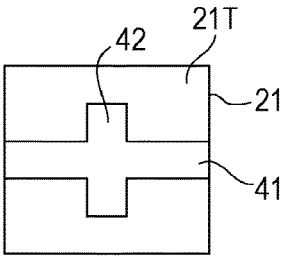
FIG. 4F is a partial perspective view illustrating a sixth example thereof.

FIG. 4F is a plan view of a support 21, illustrating a sixth example of the support 21 applied to the transformer apparatus 3 according to the present disclosure. In the sixth example, the support 21 has the shape of a square pole with a square cross-section. A first slit 41 provided in a top surface 21T traverses the top surface 21T through the center of the square from one side to an opposite side of the square. Also, the sixth example is the same as the second example in a point that a second slit 42 is provided in a direction perpendicular to the first slit 41 in such a manner as to pass through the center of the square, but differs from the second example in a point that the second slit 42 in the sixth example has a short slit length and does not reach the opposite side.

Figure 4G:
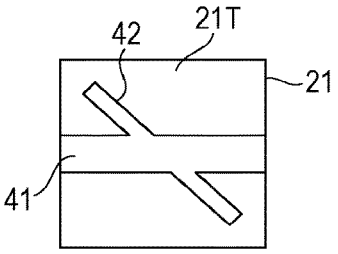
FIG. 4G is a partial perspective view illustrating a seventh example thereof.

FIG. 4G is a plan view of a support 21, illustrating a seventh example of the support 21 applied to the transformer apparatus 3 according to the present disclosure. In the seventh example, the support 21 has the shape of a square pole with a square cross-section. A first slit 41 provided in a top surface 21T traverses the top surface 21T through the center of the square from one side to an opposite side of the square. Meanwhile, a second slit 42 is provided in an oblique direction not perpendicular to the first slit 41 in such a manner as to pass through the center of the square, and has a slit width smaller than that of the first slit 41. Furthermore, the seventh example is different in a point that the second slit 42 has a short slit length and does not reach the outer periphery of the support 21.

Figure 5A:
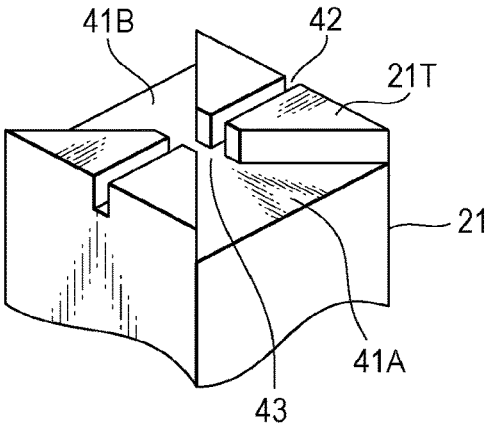
FIG. 5A is a partial perspective view illustrating an eighth example of the top surface of the support applied to the transformer apparatus according to the present disclosure.
Figure 5B:
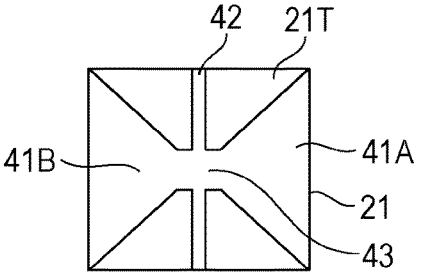
FIG. 5B is a plan view of FIG. 5A.

FIG. 5A illustrates an eighth example of the top surface 21T of the support 21 applied to the transformer apparatus 3 according to the present disclosure, and FIG. 5B is a plan view of the top surface 21T of the support 21 illustrated in FIG. 5A. In the first to seventh examples, the first slits 41 all have an elongated groove shape. In the eighth example, on the other hand, a first slit 41 has a shape including: two triangular grooves 41A and 41B facing each other from one side toward the center of the square; and a communicating slit 43 provided in the center portion of the square. The communicating slit 43 is a portion that receives solder to connect solder filled in the triangular grooves 41A and 41B. Also, the second slit 42 is provided in a direction perpendicular to the first slit 41 in such a manner as to pass through the center of the square. The second slit 42 in the eighth example is different in having a slit width smaller than that of the communicating slit 43.

Figure 5C:
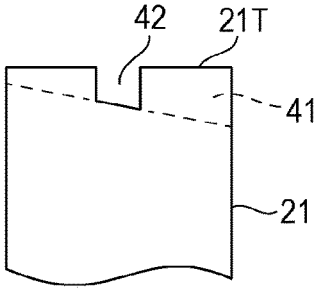
FIG. 5C is a partial side view illustrating a ninth example thereof.

FIG. 5C is a side view of the vicinity of a top surface 21T of a support 21, illustrating a ninth example of the top surface 21T of the support 21 applied to the transformer apparatus 3 according to the present disclosure. The ninth example is applicable to all of the first to eighth examples described above, and is different from the above examples in a point that a groove depth of a first slit 41 linearly changes. In the support 21 of the ninth example, the side of the first slit 41 where the groove depth is shallow is disposed on the side of a portion to wind a conductor 60 where a height thereof from the case bottom surface 20B is low.

Figure 5D:
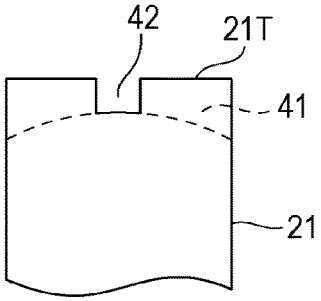
FIG. 5D is a partial side view illustrating a tenth example thereof.

FIG. 5D is a side view of the vicinity of a top surface 21T of a support 21, illustrating a tenth example of the top surface 21T of the support 21 applied to the transformer apparatus 3 according to the present disclosure. The tenth example is applicable to all of the first to eighth examples described above, and is different from the above examples in a point that a first slit 41 is formed in a curved shape such that a groove depth thereof is shallow in the center and deep on the side of the support 21. The support 21 of the tenth example is protruded on the case bottom surface 20B such that a portion of the first slit 41 where the groove depth is shallow is positioned higher than a height, from the case bottom surface 20B, of the bottom of the winding portion of the conductor 60 in winding section 32.

Here, description is given of some examples of a method for manufacturing the transformer apparatus 3 according to the present disclosure described above. FIGS. 6A to 6D are process diagrams illustrating a first example of the method for manufacturing the transformer apparatus 3 according to the present disclosure. Note that, although the transformer 10 illustrated in FIG. 6A has the winding 14 wound around the core 12, FIGS. 6B to 6D omit the illustration of the winding 14.

Figure 6A:
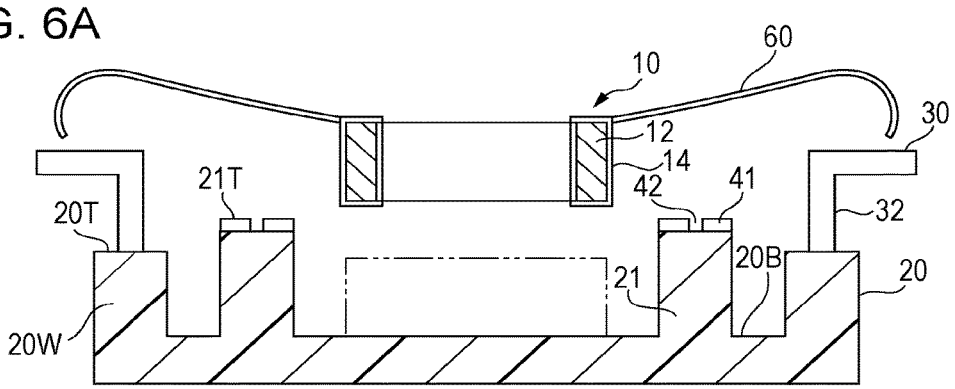
FIGS. 6A to 6D are process diagrams illustrating a first example of a method for manufacturing a transformer apparatus according to the present disclosure.

In the manufacturing method of the first example, as illustrated in FIG. 6A, a case 20 is first formed, including a bottom surface 20B that is a component mounting surface, a wall 20W, a support 21, and an external terminal 30. The wall 20W is provided adjacent to the bottom surface 20B, and a plurality of the external terminals 30 are provided on a top surface 20T of the wall 20W. The support 21 is protruded on the bottom surface 20B, and a first slit 41 and a second slit 42 are provided on the top surface 21T. The support 21 is formed integrally with the case 20, and the case 20 is formed of a resin mold, for example. In this example, the transformer 10 has a toroidal shape and the core 12 has a ring shape. A primary winding and a secondary winding are wound around the core 12, which are collectively referred to as the winding 14 here. The transformer 10 is fixed with an adhesive or the like in a position indicated by the chain double-dashed line on the bottom surface 20B of the case 20. The number of the transformers 10 mounted on the bottom surface 20B of the case 20 is not limited to a specific number.

Figure 6B:
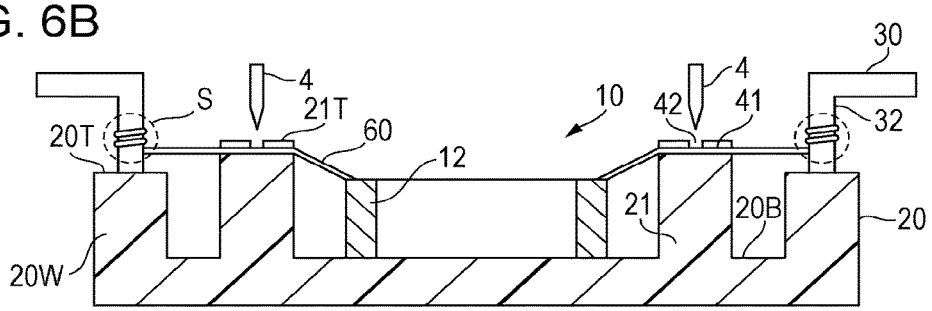

FIG. 6B illustrates a state where the transformer 10 is fixed to the bottom surface 20B of the case 20 from the state illustrated in FIG. 6A, and a conductor 60 drawn out of the core 12 is passed through the first slit 41 in the support 21 and then wound around a winding section 32 of the external terminal 30. The height of the support 21 is set such that the conductor 60 may be wound around the winding section 32 of the external terminal 30 through the first slit 41. The conductor 60 wound around the winding section 32 of the external terminal 30 is fixed by soldering with solder S. The conductor 60 has tension in this state.

Figure 6C:
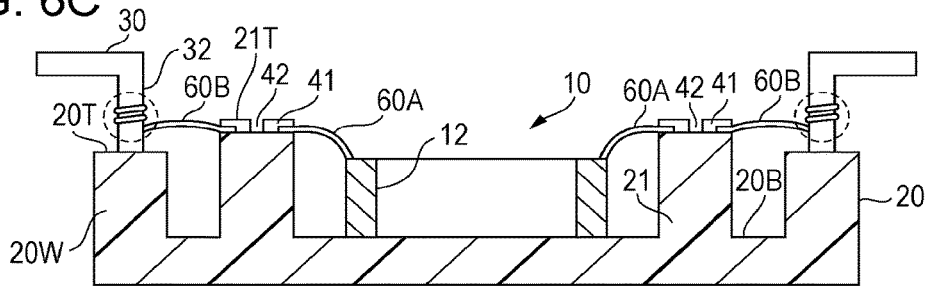

Then, in the state illustrated in FIG. 6B, a cutter 4 is inserted into the second slit 42 to cut the conductor 60 in the first slit 41. Accordingly, the conductor 60 is divided into a first conductor 60A and a second conductor 60B. It is assumed that the first conductor 60A is the conductor 60 on the core 12 side and the second conductor 60B is the conductor 60 on the external terminal 30 side. As illustrated in FIG. 6C, cut sections of the first and second conductors 60A and 60B formed by dividing the conductor 60 are separated from each other inside the first slit 41. By separating the cut sections of the first and second conductors 60A and 60B inside the first slit 41 as described above, the first conductor 60A between the support 21 and the core 12 and the second conductor 60B between the support 21 and the external terminal 30 lose their tension.

Figure 6D:
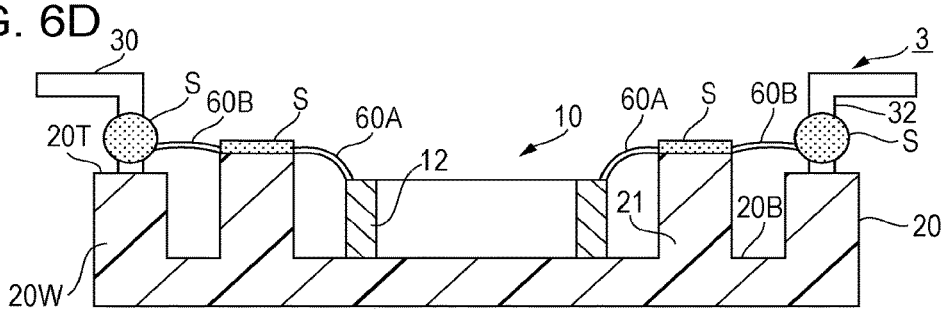

In this state, the cut sections of the first and second conductors 60A and 60B inside the first slit 41 are electrically connected to each other by the solder S as illustrated in FIG. 6D. A conductive adhesive may be used instead of the solder S. As a result, both of the first conductor 60A on the core 12 side and the second conductor 60B on the external terminal 30 side have no tension and have surplus lengths. Thus, even when the transformer apparatus 3 is cooled after soldering of the transformer apparatus 3 to a circuit board, no tension is generated in the first and second conductors 60A and 60B, making disconnection unlikely to occur. Therefore, high reliability of the connection between the external terminal 30 and the winding 14 of the transformer 10 can be maintained. Moreover, in the transformer apparatus 3 manufactured using the manufacturing method of this example, since the first and second conductors 60A and 60B are connected to each other by the solder S or conductive adhesive inside the first slit 41, the solder S does not run over the top surface 21T.

Figure 7A:
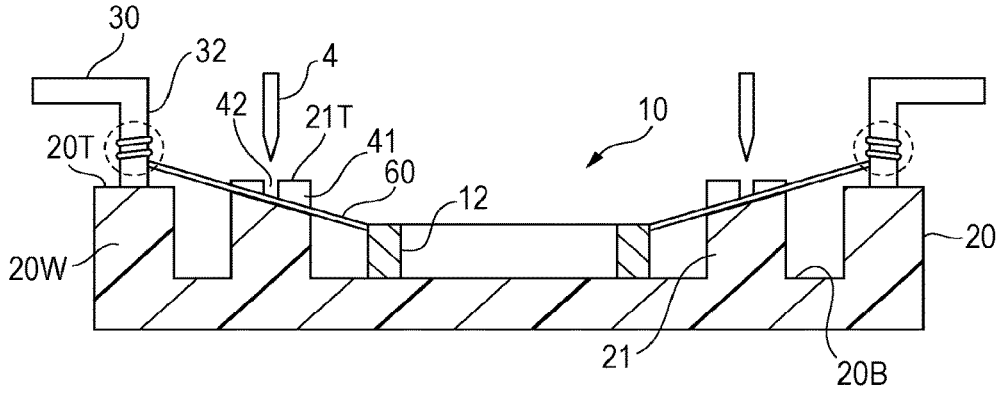
FIG. 7A is a process diagram corresponding to FIG. 6B, illustrating a modified example of the first example of the method for manufacturing a transformer apparatus according to the present disclosure.

FIG. 7A illustrates a modified example of the first example of the method for manufacturing a transformer apparatus according to the present disclosure, and corresponds to FIG. 6B in the manufacturing method of the first example. The height of the core 12 of the transformer 10 used in the manufacturing method of the first example is equal to the height of the wall 20W of the case 20. Moreover, in winding the conductor 60 around the winding section 32 of the external terminal 30, the conductor 60 is passed through the first slit 41 in the support 21. Accordingly, in the case 20 used in the manufacturing method of the first example, the height of the first slit 41 provided in the support 21 from the bottom surface 20B is set substantially equal to the height of the position from the bottom surface 20B where the winding of the conductor 60 around the winding section 32 starts.

On the other hand, as to a core 12 of a transformer 10 used in a method for manufacturing a transformer apparatus according to the modified example of the first example, a height thereof from the bottom surface 20B of the case 20 is lower than the height of the wall 20W. In this case, the height of the support 21 from the bottom surface 20B may be set substantially equal to the height of the wall 20W from the bottom surface 20B. Moreover, for the support 21, the support 21 of the ninth example illustrated in FIG. 5C may be used, which has the first slit 41 with the linearly changing groove depth.

Figure 7B:
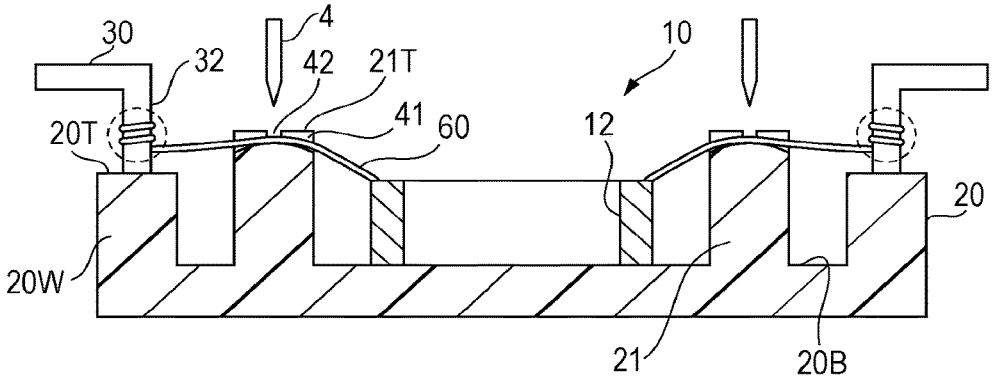
FIG. 7B is a process diagram corresponding to FIG. 6B, illustrating another modified example of the first example of the method for manufacturing a transformer apparatus according to the present disclosure.

FIG. 7B illustrates another modified example of the first example of the method for manufacturing a transformer apparatus according to the present disclosure, and corresponds to FIG. 6B in the manufacturing method of the first example. The height of the core 12 of the transformer 10 used in the manufacturing method of the first example is substantially equal to the height of the wall 20W of the case 20. Moreover, in winding the conductor 60 around the winding section 32 of the external terminal 30, the conductor 60 is passed through the first slit 41 in the support 21. Accordingly, in the case 20 used in the manufacturing method of the first example, the height of the first slit 41 provided in the support 21 from the bottom surface 20B is set substantially equal to the height of the position from the bottom surface 20B where the winding of the conductor 60 around the winding section 32 starts.

The manufacturing method of the other modified example of the first example is an example where large surplus lengths of the first and second conductors 60A and 60B are realized when the height of the core 12 of the transformer 10 from the bottom surface 20B of the case 20 is substantially equal to the height of the wall 20W. Accordingly, in the other modified example of the first example, the height of the support 21 from the bottom surface 20B is set higher than the height of the support 21 from the bottom surface 20B, which is used in the method for manufacturing a transformer apparatus according to the first example. Moreover, the groove of the first slit 41 provided in the support 21 is formed to have a curved bottom surface such that contact of the conductor 60 does not locally occur during winding of the conductor 60 around the winding section 32 of the external terminal 30. The support 21 of the tenth example illustrated in FIG. 5D can be used in the method for manufacturing a transformer apparatus according to the other modified example of the first example.

Next, with reference to process diagrams illustrated in FIGS. 8A and 8B and FIGS. 9A and 9B, description is given of a second example of the method for manufacturing the transformer apparatus 3 according to the present disclosure. Note that, although the transformer 10 illustrated in FIG. 8A has the winding 14 wound around the core 12, FIG. 8B and FIGS. 9A and 9B omit the illustration of the winding 14.

Figure 8A:
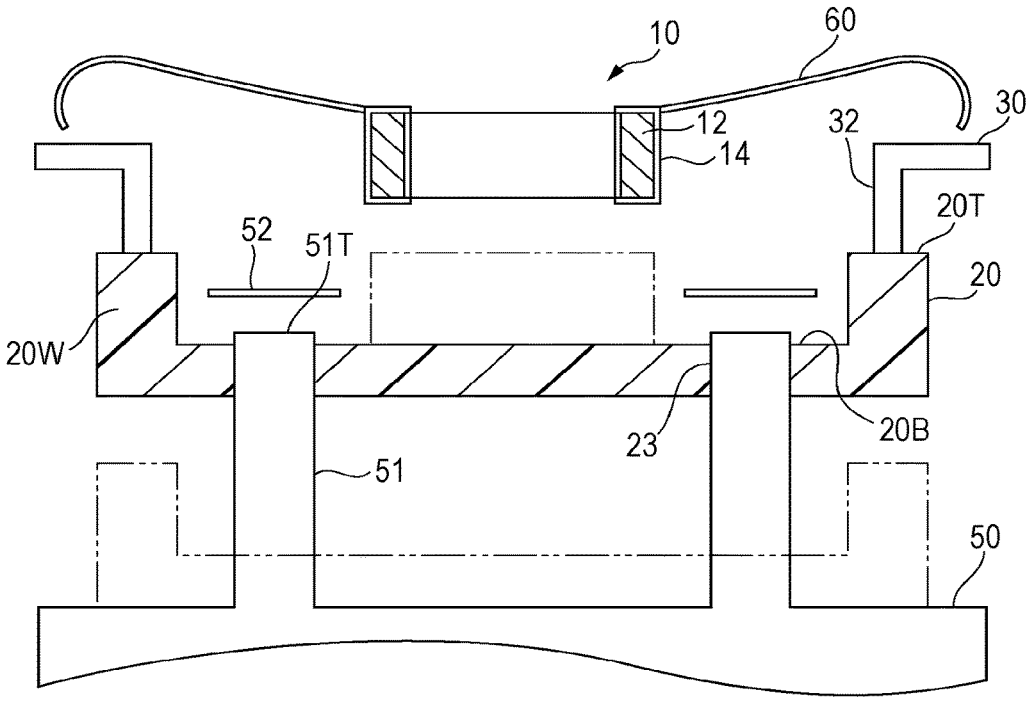
FIGS. 8A and 8B are some of process diagrams illustrating a second example of the method for manufacturing a transformer apparatus according to the present disclosure.

In the manufacturing method of the second example, as illustrated in FIG. 8A, a case 20 is first formed, including a bottom surface 20B that is a component mounting surface, a wall 20W, a through-hole 23, and an external terminal 30. The wall 20W is provided adjacent to the bottom surface 20B, and a plurality of the external terminals 30 are provided on a top surface 20T of the wall 20W. Two through-holes 23 are provided for a transformer 10 in a region between the wall 20W and a portion indicated by the chain double-dashed line, where the transformer 10 is to be mounted, on the bottom surface 20B of the case 20. The case 20 is formed of a resin mold, for example. In this example, the transformer 10 has a toroidal shape and the core 12 has a ring shape. A primary winding and a secondary winding are wound around the core 12, which are collectively referred to as the winding 14 here. The transformer 10 is fixed with an adhesive or the like in a position indicated by the chain double-dashed line on the bottom surface 20B of the case 20. The number of the transformers 10 mounted on the bottom surface 20B of the case 20 is not limited to a specific number.

In the manufacturing method of the second example, the case 20 having the structure as described above is mounted on a base 50 with mounting shafts 51 in a state where the mounting shafts 51 are inserted into the through-holes 23. Also, relay sheets 52 are placed on top surfaces 51T of the mounting shafts 51. The external shape of each of the relay sheets 52 is formed larger than that of the through-hole 23. The relay sheet 52 is made of an insulator and may have a land pattern formed of a copper foil to fix the conductor on the upper side with solder. The chain double-dashed line drawn on the base 50 illustrated in FIG. 8A indicates the position of the case 20 on the base 50.

Figure 8B:
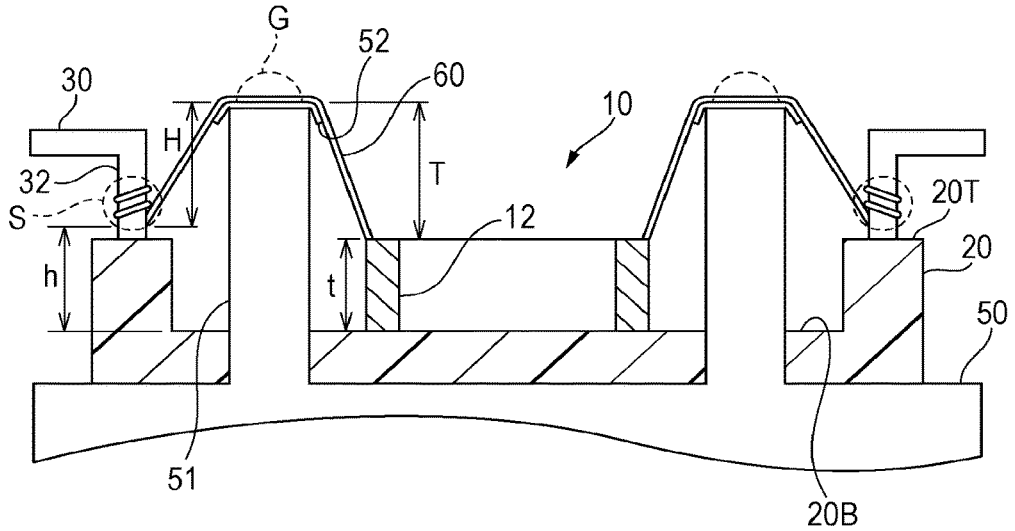

FIG. 8B illustrates a state where the case 20, on which the transformer 10 is fixed, is placed on the base 50 from the state illustrated in FIG. 8A, and the conductor 60 drawn out of the core 12 is wound around the winding section 32 of the external terminal 30 via the relay sheets 52 placed on the top surfaces of the mounting shafts 51. The position of the conductor 60 is fixed with an adhesive G or the like on the relay sheets 52. When a copper foil pattern is provided in each of the relay sheets 52, the conductor 60 may be fixed with solder. Moreover, the conductor 60 wound around the winding section 32 of the external terminal 30 is electrically connected with solder S or a conductive adhesive.

Here, it is assumed that a height of a winding start position, where winding of the conductor 60 around the winding section 32 of the external terminal 30 starts, from the bottom surface 20B of the case 20 is h and a height of the mounting shafts 51 from the winding start position when the case 20 is placed on the base 50 is H. Also, it is assumed that a height of the core 12 from the bottom surface 20B is t and a height of the mounting shafts 51 from the upper part of the core 12 is T. When the case 20 is removed from the base 50 from the state illustrated in FIG. 8B, the relay sheets 52 placed on the mounting shafts 51 move to the bottom surface 20B of the case 20.

In this event, the height of the mounting shafts 51 is set such that the height H of the mounting shafts 51 from the winding start position of the conductor 60 is larger than the height h of the winding start position of the conductor 60 around the winding section 32 of the external terminal 30 from the bottom surface 20B. Similarly, the height of the bottom surface 20B of the core 12 is set such that the height T of the mounting shafts 51 from the upper part of the core 12 is larger than the height t of the core 12 from the bottom surface 20B. In other words, the height of the mounting shafts 51, which is obtained by subtracting a height of a depth portion of the through-hole 23, is set more than twice as large as the height of the core 12 in the transformer 10 mounted on the bottom surface 20B.

Figure 9A:
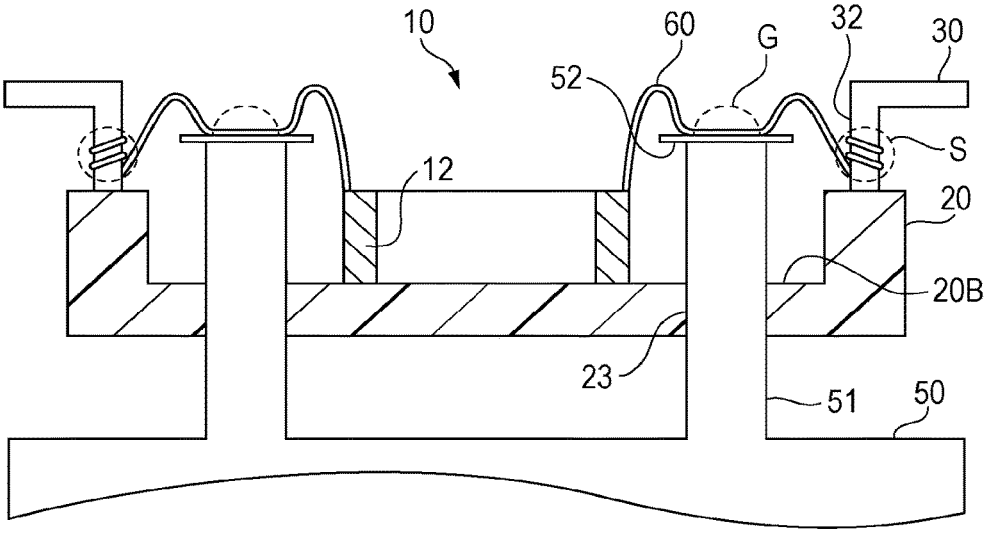
FIGS. 9A and 9B are some of process diagrams illustrating the second example of the method for manufacturing a transformer apparatus according to the present disclosure.

FIG. 9A illustrates a state where the case 20 is being pulled out from the base 50 from the state illustrated in FIG. 8B. Since the relay sheets 52 move together with the mounting shafts 51, the relay sheets 52 gradually approach the bottom surface 20B of the case 20 and the conductor 60 gradually bends. A bend amount of the conductor 60 is at its maximum when the relay sheets 52 are positioned around the upper part of the core 12 in the transformer 10. As the relay sheets 52 approach the bottom surface 20B from this position, the bend amount of the conductor 60 is gradually decreased.

Figure 9B:
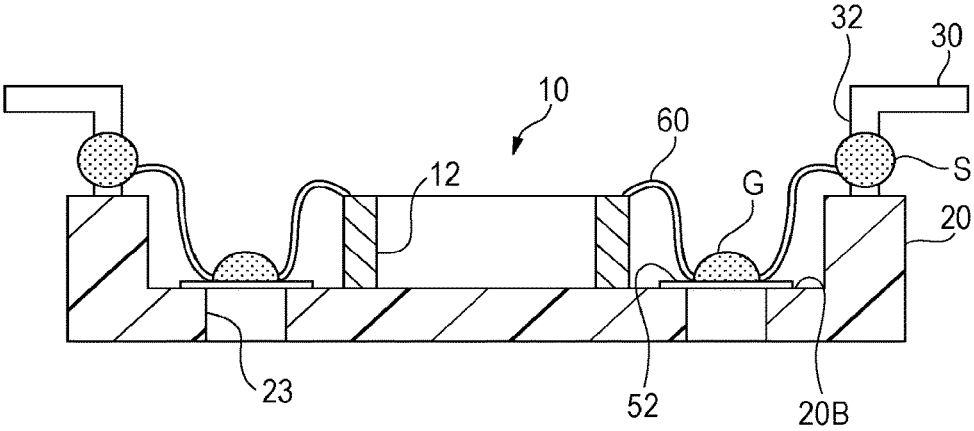

FIG. 9B illustrates a state where the case 20 is completely pulled out from the base 50. Since the external shape of the relay sheets 52 is larger than that of the through-holes 23, the relay sheets 52 are placed on the bottom surface 20B of the case 20 in a state of blocking the through-holes 23. In this state, the relay sheets 52 may be fixed on the bottom surface 20B with an adhesive or the like. Since the relay sheets 52 are formed of the insulator as described above, insulation of the front-side surface of the case is ensured even when the relay sheets 52 are attached to the bottom surface 20B of the case 20. Moreover, the through-holes 23 provided in the case 20 may be closed with a resin or the like.

In the state where the relay sheets 52 are placed on the bottom surface 20B of the case 20, both of the conductor 60 between the core 12 and the relay sheet 52 and the conductor 60 between the external terminal and the relay sheet 52 have no tension and have surplus lengths, based on the relationships H>h and T>t described above. As a result, even when the transformer apparatus 3 manufactured using the manufacturing method of the second example is cooled after soldering of the transformer apparatus 3 to a circuit board, no tension is generated in the conductor 60, making disconnection unlikely to occur. Thus, high reliability of the connection between the external terminal 30 and the winding 14 of the transformer 10 is maintained.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A method for manufacturing a transformer apparatus using a case including a component mounting surface, a wall for surrounding the component mounting surface, an external terminal provided on the wall, and a support protruded on the component mounting surface, the support including a slit that traverses a top surface, the method comprising:

inserting a conductor of a winding in a transformer through the slit, the transformer including the winding and a magnetic core placed on the component mounting surface and the winding being drawn from the core, and then electrically connecting the conductor by winding an end of the conductor around the external terminal;

cutting the conductor within the slit and separating cut edges thereof within the slit; and electrically connecting the cut edges in the separated state within the slit by using a conductive member.

2. The method for manufacturing a transformer apparatus according to claim 1, wherein external terminals are provided on walls provided on two opposite sides of the component mounting surface.

3. The method for manufacturing a transformer apparatus according to claim 1, wherein the support is provided integrally with the case on the component mounting surface by using a mold to form the case.

4. A method for manufacturing a transformer apparatus using a case including a component mounting surface, a wall surrounding the component mounting surface, an external terminal provided on the wall, and a hole provided in the component mounting surface, the method comprising:

placing the case on a base by inserting a mounting shaft into the hole, the base having the mounting shaft protruded thereon and the mounting shaft corresponding to a position of the hole;

disposing a relay sheet on a top surface of the mounting shaft, the relay sheet having an external shape larger than that of the hole;

electrically connecting an end of a conductor of a winding in a transformer including the winding and a magnetic core placed on the component mounting surface by winding the end of the conductor around the external terminal in a state where an intermediate section of the conductor is placed on the relay sheet;

fixing the intermediate section of the conductor to the relay sheet;

wherein the mounting shaft is formed such that a height thereof protruding from the component mounting surface is more than twice as large as a height of the core in the transformer placed on the component mounting surface; and generating surplus lengths in a portion of the conductor between the external terminal and the relay sheet and in a portion thereof between the relay sheet and the core when the case is removed from the base and the relay sheet is placed on the component mounting surface.

5. The method for manufacturing a transformer apparatus according to claim 4, wherein the relay sheet is formed of an insulating member, and the intermediate section is fixed onto the relay sheet with an adhesive.

6. The method for manufacturing a transformer apparatus according to claim 4, wherein the relay sheet includes a metal member at least on an upper surface thereof, and the intermediate section is fixed on the metal member with solder.

7. The method for manufacturing a transformer apparatus according to claim 4, wherein external terminals are provided on walls provided on two opposite sides of the component mounting surface.

* * * * *